US008485803B2

(12) United States Patent
Lee et al.

(10) Patent No.: US 8,485,803 B2
(45) Date of Patent: Jul. 16, 2013

(54) SCROLL COMPRESSOR COMPRISING OIL SEPARATING DRIVING SHAFT

(75) Inventors: Geonho Lee, Seongnam-si (KR); Inhwe Koo, Seongnam-si (KR)

(73) Assignees: Doowon Technical College, Anseing-Shi (KR); Doowon Electronic Co., Ltd., Asan-Shi (KR)

( * ) Notice: Subject to any disclaimer, the term of this patent is extended or adjusted under 35 U.S.C. 154(b) by 401 days.

(21) Appl. No.: 12/919,496

(22) PCT Filed: Feb. 27, 2009

(86) PCT No.: PCT/KR2009/000953
§ 371 (c)(1),
(2), (4) Date: Aug. 26, 2010

(87) PCT Pub. No.: WO2009/108007
PCT Pub. Date: Sep. 3, 2009

(65) Prior Publication Data

US 2010/0329915 A1 Dec. 30, 2010

(30) Foreign Application Priority Data

Feb. 29, 2008 (KR) ..... 10-2008-0018994

(51) Int. Cl.

| | |
|---|---|
| ***F01C 1/02*** | (2006.01) |
| ***F01C 1/063*** | (2006.01) |
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |

(52) U.S. Cl.
USPC ..... 418/55.6; 418/88; 418/91; 418/94; 418/97; 418/98

(58) Field of Classification Search
USPC ..... 418/55.6, 86
See application file for complete search history.

(56) References Cited

U.S. PATENT DOCUMENTS 4,462,772 A * 7/1984 Hazaki et al. ..... 418/55.6
5,000,669 A * 3/1991 Shimizu et al. ..... 418/1

(Continued)

FOREIGN PATENT DOCUMENTS

| | | |
|---|---|---|
| JP | 05-157079 | 6/1993 |
| JP | 06-026483 | 2/1994 |
| JP | 10-141251 | 5/1998 |

OTHER PUBLICATIONS

International Search Report. Oct. 19, 2009.

*Primary Examiner* — Thomas Denion
*Assistant Examiner* — Mickey France
(74) *Attorney, Agent, or Firm* — Ballard Spahr LLP

(57) ABSTRACT

The present invention relates to a scroll compressor, with an oil-separating drive shaft, that comprises a housing a fixed scroll which is installed inside the housing, a orbiting scroll which orbits around the fixed scroll, and a drive shaft which drives the orbiting scroll. In the orbiting scroll, a discharge hole is formed. A discharge path is formed along the longitudinal direction of the drive shaft so that discharged coolant from the discharge hole flows therethrough. At least, a part of the discharge path is inclined forward from the rotary axis to the exterior. A lubrication hole is formed in the drive shaft that penetrates from the discharge path to the outer surface of the drive shaft.

2 Claims, 5 Drawing Sheets

U.S. PATENT DOCUMENTS 5,247,736 A * 9/1993 Fraser et al. ..... 29/888.022
5,624,243 A * 4/1997 Omodaka et al. ..... 417/366
6,139,295 A * 10/2000 Utter et al. ..... 418/55.6
2002/0098102 A1* 7/2002 Gennami et al. ..... 418/55.4
2004/0101428 A1* 5/2004 Shibamoto et al. ..... 418/55.2
2009/0136372 A1* 5/2009 Elson et al. ..... 418/55.6
2010/0329915 A1* 12/2010 Lee et al. ..... 418/55.6

* cited by examiner

PRIOR ART

SCROLL COMPRESSOR COMPRISING OIL SEPARATING DRIVING SHAFT

CROSS REFERENCE TO RELATED APPLICATIONS

The present application is a National Phase Application of International Application No. PCT/KR2009/000953, filed Feb. 27, 2009, which claims priority to Korean Patent Application No. 10-2008-0018994 filed Feb. 29, 2008, which applications are incorporated herein fully by this reference.

TECHNICAL FIELD

The present invention relates to a scroll compressor with an oil separating drive shaft, and more particularly to a scroll compressor with an oil separating drive shaft in which oil and coolant gas are separated by the centrifugal force while coolant is being discharged through the interior of the drive shaft.

BACKGROUND ART

In general, a scroll compressor includes a fixed scroll which has a spiral scroll wrap and maintains its fixed state regardless of rotation of a drive shaft, and a orbit scroll which also has a spiral scroll wrap and orbits during rotation of the drive shaft. In such a scroll compressor, the orbiting scroll orbits with respect to the fixed scroll with coolant being suctioned into a compressor chamber formed between the fixed scroll and the orbiting scroll, so as to compress the coolant.

An example of such a scroll compressor is disclosed in Korean Patent Laid-Open No. 2000-0041250 which will be briefly described with reference to FIG. 1.

As illustrated in FIG. 1, the conventional scroll compressor includes a compression mechanism for compressing coolant and a transmission mechanism for providing a driving force to the compression mechanism through a main shaft 3.

The transmission mechanism includes a stator 1 and a rotor 2, and the main shaft 3 is press-fitted into the rotor 2 to rotate in conjunction with the rotor 2.

The compression mechanism includes a fixed scroll 4 and a orbiting scroll 5. The coolant introduced through a suction pipe 6 is suctioned into compression chambers formed by the involuted wraps of the fixed scroll 4 and the orbiting scroll 5. When the main shaft 3 rotates, an Oldham ring 10 positioned on an upper frame 8 and a sliding bush 9 is connected to the orbiting scroll 5 through a unidirectional key groove so as to convert the rotation of the main shaft 3 to the orbit of the orbiting scroll 5.

Accordingly, the coolant introduced between the fixed scroll 4 and the orbiting scroll 5 gathers the two semicircular compression chambers formed by the two scroll wraps toward the centers of the scrolls to perform a compression operation.

As a result, the centrally gathered compression coolant is opened at a discharge port 11 on the rear surface of the fixed scroll 4, and the compressed coolant passes through the housing and is sent to a refrigerating/air conditioning cycle through a discharge pipe 12.

Meanwhile, it is necessary to supply lubricant frequently in order to minimize wear of the transmission mechanism and the compression mechanism. For this purpose, an oil pump 14 communicated with the main shaft 3 is provided below a lower frame 101.

The oil pump 14 is operated by the pressure difference in the compressor. That is, as the coolant of high temperature and high pressure discharged through the discharge port 11 flows from the left side to the right side, a pressure difference occurs between the suction side and the discharge side to operate the oil pump 14.

When the oil pump 14 is operated, the oil is supplied to the compression mechanism and the transmission mechanism through holes 3*a* formed within the main shaft 3 or grooves formed around the main shaft 3. The operation of the oil lubricates the mechanisms.

Here, the surface of the oil rises inclinedly toward the oil pump 14 due to the pressure difference during the supply of the coolant, and the oil which has performed the lubricating operation using the pressure difference flows toward the oil pump 14. Then, the oil is mixed with the coolant of high temperature and high pressure.

That is, when the oil which has performed the lubricating operation exits a coolant passage 102 formed in the lower frame 101, it is mixed with the coolant of high temperature and high pressure and collides with an oil separating plate 103 formed on the discharge side of the coolant passage 102.

In the process, the oil is separated from the coolant and is bent toward the lower side of a shell 15 by an inertial force to gather again, and the coolant of high temperature and high pressure exits the coolant passage 102 and then is discharged to the refrigerating/air conditioning cycle through the discharge pipe 12.

However, in the conventional scroll compressor, the holes 3*a* lengthwisely formed in the drive shaft functions only as a supply passage of oil but fails to function as a discharge passage.

Furthermore, although the conventional scroll compressor discloses a structure for separating oil from suctioned coolant, oil is separated regardless of the rotational speed of the drive shaft. Thus, oil cannot be sufficiently separated, resulting in decrease in the efficiency of the compressor. That is, since the oil separator is fixed even when the drive shaft of the compressor rotates at a high RPM due to a high thermal load, oil cannot be separated at a high efficiency.

DISCLOSURE

Technical Problem

Therefore, it is an object of the present invention to provide a scroll compressor with an oil separating drive shaft which enhances the efficiency of the compressor by efficiently separating oil from coolant gas while the coolant containing the oil is discharged from the drive shaft.

It is another object of the present invention to provide a scroll compressor with an oil separating drive shaft which efficiently cope with a thermal load by separating oil according to the rotational speed of the drive shaft.

It is still another object of the present invention to provide a scroll compressor with an oil separating drive shaft which lubricates the drive shaft at its arbitrary lengthwise portion.

Technical Solution

In order to achieve the above-mentioned objects, there is provided a scroll compressor with an oil separating drive shaft comprising: a housing; a fixed scroll fixed within the housing; a orbiting scroll orbiting about the fixed scroll; and a drive shaft driving and orbiting the orbiting scroll, wherein a discharge opening is formed in the orbiting scroll, a discharge passage passes through the interior of the drive shaft lengthwisely to circulate the coolant discharged from the discharge opening, at least one section of the discharge passage is inclined from the axis of the drive shaft to the outside as it goes from the rear side to the front side, a lubrication hole extending from the discharge passage to the outer surface of the drive shaft is formed in the drive shaft.

An oil storage may be formed at an end of the inclined section of the discharge passage which is close to the orbiting scroll.

The oil storage may have a cylindrical shape whose cross-section is larger than that of the inclined section.

The lubrication hole may be communicated with the oil storage.

An auxiliary lubrication hole extending from the discharge passage to the outer periphery of the drive shaft may be formed in the vicinity of a rotation support of the drive shaft.

Advantageous Effect

According to the present invention, when coolant containing oil is discharged from the drive shaft, the oil is efficiently separated from the coolant gas, making it possible to prevent the efficiency of the compressor from being lowered.

Further, oil is separated according to the rotational speed of the drive shaft, making it possible for the compressor to easily cope with a thermal load.

Furthermore, due to the lubrication holes formed at arbitrary points in the lengthwise direction of the drive shaft, lubrication is properly performed.

MODE FOR INVENTION

Figure 1:
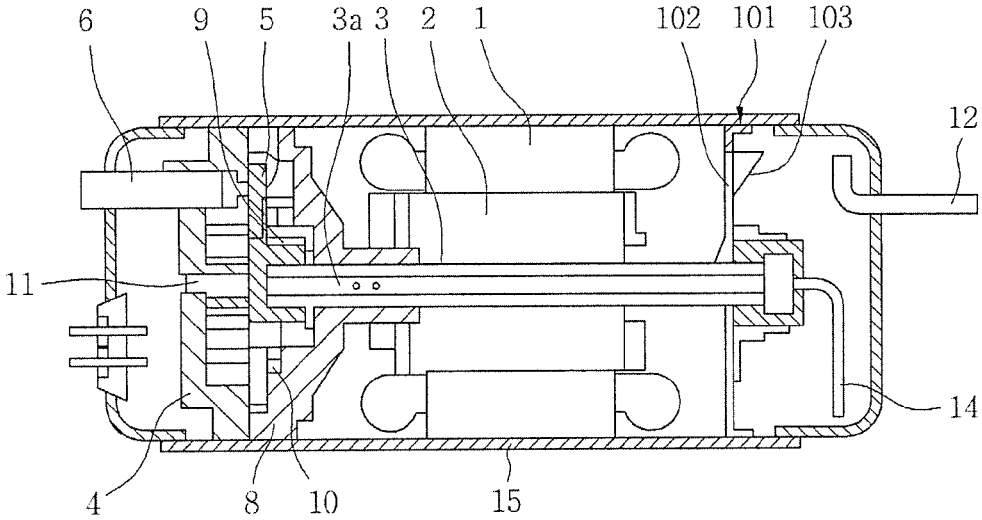
FIG. 1 is a longitudinal sectional view illustrating a conventional scroll compressor.

Hereinafter, an exemplary embodiment of the present invention will be described in detail with reference to FIGS. 2 to 5.

As illustrated in figures, the scroll compressor 1000 with an oil separating drive shaft according to the present invention includes a housing 100, a suction port 600 and a discharge port 700 formed in the housing 100, a fixed scroll 810 and a orbiting scroll 820 accommodated within the housing 100 and engaged with each other, a drive shaft 830, a driving motor 840, a sliding bush 850 installed between the tip end of the drive shaft 830 and the orbiting scroll 820 and configured to induce the orbit (revolution) of the orbiting scroll 820, and rotation preventing means 860 such as a Oldham ring for preventing rotation of the orbiting scroll 820. The drive shaft 830, the driving motor 840, the sliding bush 850, and the rotation preventing means 860 constitutes orbit driving means of the orbiting scroll 820.

In the figures, the fixed scroll 810 is located on the front side and the orbiting scroll 820 is located on the rear side.

Figure 3:
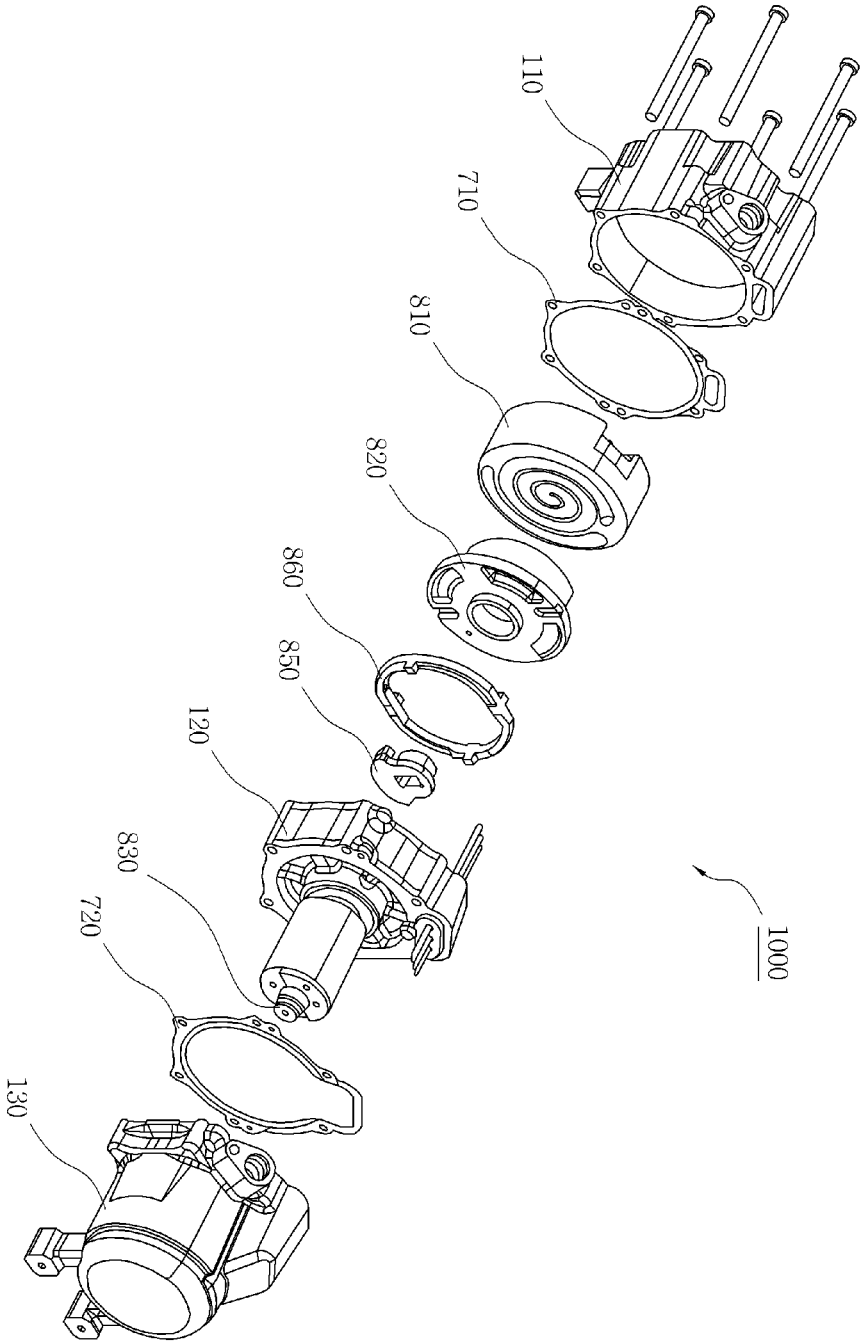
FIG. 3 is an exploded perspective view illustrating the scroll compressor with an oil separating drive shaft according to the present invention.
Figure 4:
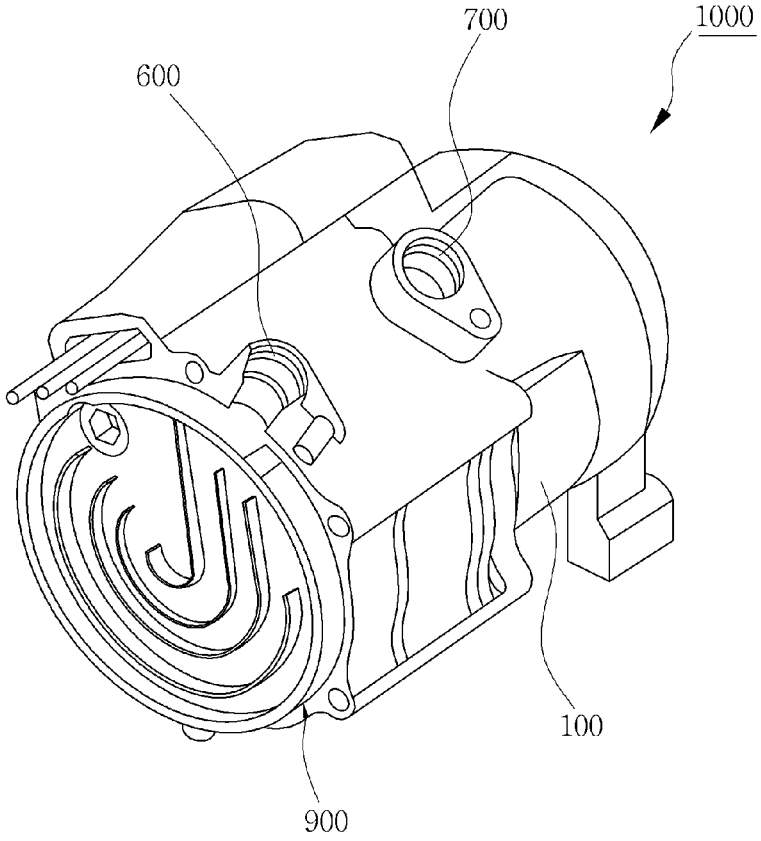
FIG. 4 is a front perspective view of FIG. 2 in which an inverter is removed.
Figure 5:
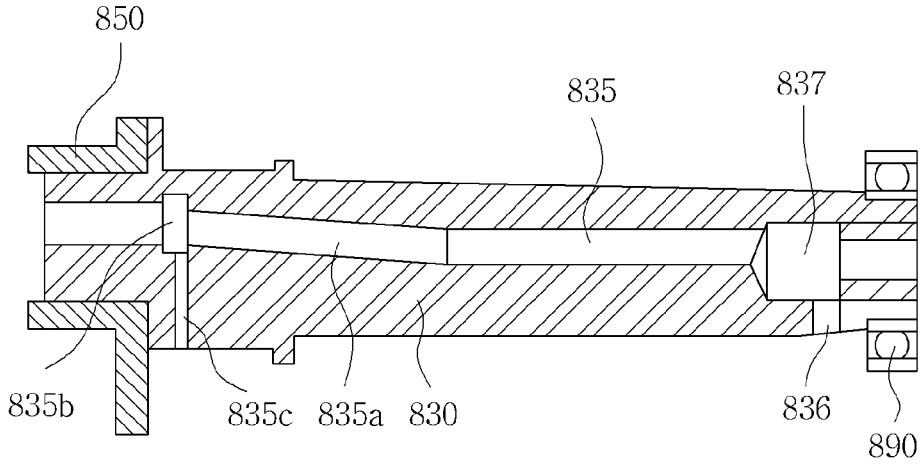
FIG. 5 is an enlarged sectional view illustrating an oil separating structure of FIG. 2 in detail.

In FIG. 3, the housing 100 includes a front inverter housing 110, a rear main housing 130, and a main frame 120 disposed between the inverter housing 110 and the main housing 130. Meanwhile, various examples well-known in the art may be employed for the housing 100.

The housing has the suction port 600 and the discharge port 700 such that coolant is suctioned from an evaporator through the suction port 600, and after compressed in a compression chamber 880 between the fixed scroll 810 and the orbiting scroll 820, it is sent to a condenser through the discharge port 700.

In particular, according to the present invention, an inverter 200 is disposed on the front surface of the fixed scroll 810 to be opposite to the fixed scroll 810, and a suction opening 815 passes through the fixed scroll 810 to the compression chamber 880. The suction opening 815 is formed in the vicinity of the outer periphery of the fixed scroll 810 such that the suctioned coolant is discharged while it is compressed from the outer periphery of the fixed scroll 810 toward the center thereof.

A guide 900 for guiding the coolant suctioned from the suction port 600 to the suction opening 815 is formed on the front surface of the fixed scroll 810 opposite to the inverter 200.

Accordingly, the suctioned coolant flows between the inverter 200 and the guide 900 to simultaneously cool the inverter 200 and the compression chamber 880.

Meanwhile, the guide 900 may be omitted such that the suctioned coolant passes between the inverter 200 and the fixed scroll 810 and the coolant is suctioned into the compression chamber 880 through the suction opening 815 of the fixed scroll 810.

Although the inverter 200 is opposite to the fixed scroll 810 for a cooling operation, it may have various structures. For example, it may be positioned at a side of the housing 100.

Moreover, the coolant may be suctioned directly through the suction port 600 by forming a suction chamber in front of the fixed scroll 810 with the guide being omitted.

Meanwhile, the coolant which have passed through the compression chamber 880 passes through the discharge opening 821 formed in the orbiting scroll 820 and then is discharged through the discharge port 700. In particular, a discharge passage 835 penetrates the drive shaft 830 lengthwisely such that the suctioned coolant passes through the rear end of the housing 100 and then is discharged.

An inclined section 835*a* is formed at a portion of the discharge passage 835 formed in the drive shaft 830 so as to be inclined from the axis of the drive shaft 830 outward as it goes from the rear side toward the front side.

Due to the structure, the coolant containing oil passes through the compression chamber 880 and liquid is separated from gas by the centrifugal force when the coolant passes through the discharge passage 835.

In more detail, although the discharge passage 835 coincides with the axis of the drive shaft 830 at the rear end of the drive shaft 830 such that the centrifugal force applied to the oil is vertically applied to the inner surface of the discharge passage 835, a component of the centrifugal force in the lengthwise direction of the drive shaft 830 exists in the inclined section 835*a*, applying a force in the lengthwise forward direction of the drive shaft 830 to oil particles.

Accordingly, as the drive shaft 830 rotates, when the suctioned coolant, i.e. a mixture of oil and coolant gas flows, the oil is separated by the centrifugal force and flows in a direction opposite to that of the suctioned coolant by the inclined section 835*a* of the discharge passage 835.

Meanwhile, an oil storage 835*b* is formed at an end of the inclined section of the discharge passage 835 which is close to the orbiting scroll 820 to temporarily gather the reversed oil.

For this purpose, the cross-section of the oil storage 835*b* is larger than that of the inclined section 835*a*. In this case, the cross-section of the oil storage 835*b* may be circular to smoothly supply oil. However, the cross-section of the oil storage 835*b* may not be specifically defined.

A lubrication hole 835*c* extending from the discharge passage 835 to the outer surface of the drive shaft 830 is formed in the oil storage 835*b* to supply oil to a main bearing 870, etc. during the rotation of the drive shaft 830.

Meanwhile, the oil storage 835*b* may be omitted and a lubrication hole may be formed at one end of the inclined section 835*a* which is close to the orbiting scroll 820.

An auxiliary lubrication hole 836 extending from the discharge passage 835 to the outer periphery of the drive shaft 830 may be formed in the vicinity of a rotation support (bearing 890) of the drive shaft 830 to efficiently lubricate the peripheral elements including the rotation support 890. In this case, the auxiliary lubrication hole 836 may extend from an auxiliary oil storage 837 formed in the discharge passage 835 to the outer peripheral surface of the drive shaft 830.

The reference numerals 710 and 720 represents gaskets.

Figure 2:
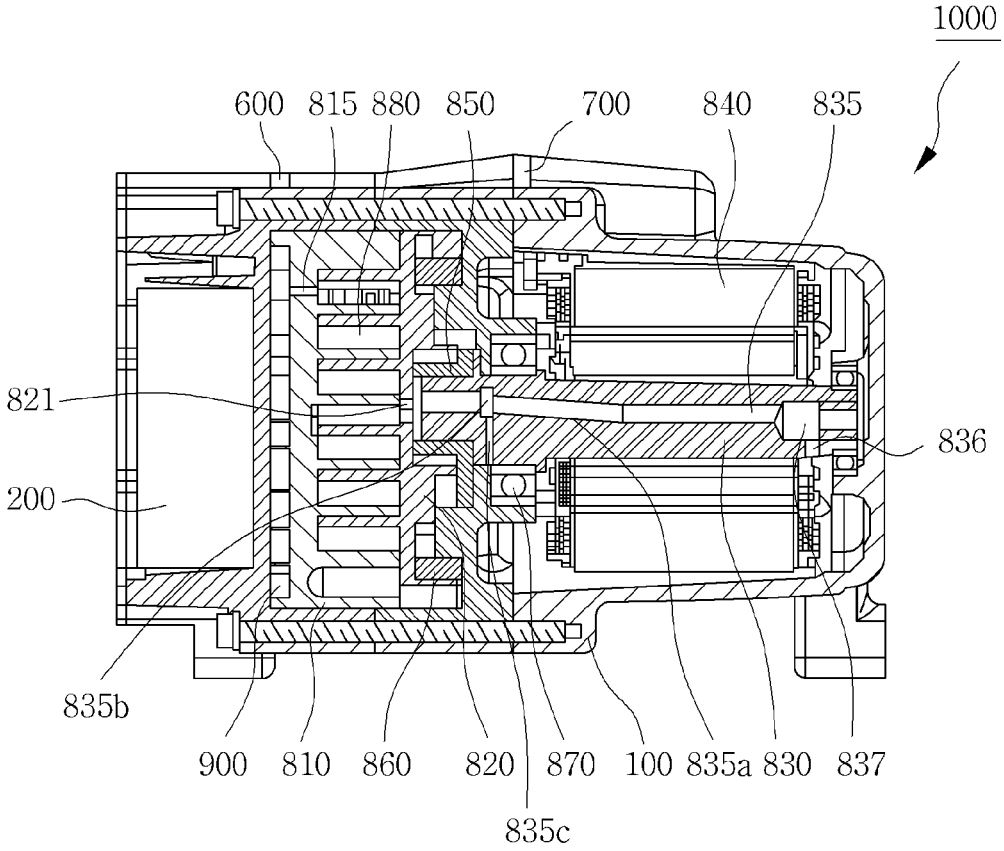
FIG. 2 is a longitudinal sectional view illustrating a scroll compressor with an oil separating drive shaft according to the present invention.

Hereinafter, the operations of circulating the suctioned oil and separating oil by the scroll compressor with an oil separating drive shaft according to the present invention will be described with reference to FIGS. 2 and 3.

First, the coolant is introduced through the suction port 600 formed in the housing 100 from the evaporator (not shown).

The suctioned coolant passes through the guide 900 between the inverter 200 and the fixed scroll 810 and is introduced into the compression chamber 880 through the guide 900 and the suction opening 815 of the fixed scroll 810.

The coolant compressed in the compression chamber 880 passes through the discharge opening 821 formed in orbiting scroll 820 and then passes through the discharge passage 835 formed in the drive shaft 830 lengthwisely.

Then, since a section of the discharge passage 835 is inclined, oil is separated to flow backward toward the orbiting scroll 820 by the centrifugal force as the drive shaft 830 rotates, and the remaining coolant gas flows toward the discharge port 700 through the discharge passage 835. The backwardly flowing oil is temporarily stored in the oil storage 835*b* and is supplied to a space around the main bearing 870 through the lubrication hole 835*c* to lubricate the main bearing 870.

Meanwhile, the oil separated from the rear end region of the drive shaft 830 gathers in the auxiliary oil storage 837 and is supplied to the periphery of the rotation support 890 through the auxiliary lubrication hole 836 to lubricate the rear end of the drive shaft 830.

Finally, the gaseous coolant from which the oil is separated passes through the rear end of the housing 100 and is discharged to the discharge port 700 through a passage formed between the driving motor and the housing 100.

For this purpose, a groove extending radially is formed at the rear end of the housing 100 to allow passage of the coolant.

INDUSTRIAL APPLICABILITY

According to the present invention, when coolant containing oil is discharged from the drive shaft, the oil is efficiently separated from the coolant gas, making it possible to prevent the efficiency of the compressor from being lowered.

Further, oil is separated according to the rotational speed of the drive shaft, making it possible for the compressor to easily cope with a thermal load.

Furthermore, due to the lubrication holes formed at arbitrary points in the lengthwise direction of the drive shaft, lubrication is properly performed.

The invention claimed is:

1. A scroll compressor with an oil separating drive shaft comprising:

a housing;

a fixed scroll fixed within the housing;

an orbiting scroll configured to orbit about the fixed scroll;

a drive shaft configured to drive and orbit the orbiting scroll;

a main bearing supporting the front part of the drive shaft; and a rotation support supporting the rear part of the drive shaft, wherein a discharge opening is formed in the orbiting scroll, a discharge passage passes through the interior of the drive shaft lengthwise to circulate the coolant discharged from the discharge opening, at least one section of the discharge passage is inclined from the axis of the drive shaft to the outside as it goes from the rear side to the front side, and wherein an oil storage is formed at an end of the inclined section of the discharge passage, which is close to the orbiting scroll and has a lubrication hole extending from the discharge passage to the outer surface of the drive shaft and communicating with the main bearing, and an auxiliary oil storage has an auxiliary lubrication hole, formed in the vicinity of the rotation support of the drive shaft, extending from the discharge passage to the outer surface of the drive shaft, and communicating with the rotation support, such that the oil separated in the inclined section of the discharge passage by the centrifugal force flows backward to the oil storage to be discharged through the lubrication hole while the oil separated from the rear end of the drive shaft gathers in the auxiliary oil storage and after that is discharged through the auxiliary lubrication hole.

2. The scroll compressor as claimed in claim 1, wherein the oil storage has a cylindrical shape whose cross-section is larger than that of the inclined section.

* * * * *

UNITED STATES PATENT AND TRADEMARK OFFICE

CERTIFICATE OF CORRECTION

PATENT NO. : 8,485,803 B2
APPLICATION NO. : 12/919496
DATED : July 16, 2013
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 400 days.

Signed and Sealed this
Eighth Day of September, 2015

Michelle K. Lee

Michelle K. Lee
*Director of the United States Patent and Trademark Office*